US010748521B1

(12) United States Patent
Mulvey et al.

(10) Patent No.: US 10,748,521 B1
(45) Date of Patent: Aug. 18, 2020

(54) REAL-TIME DETECTION OF CONDITIONS IN ACOUSTIC DEVICES

(71) Applicant: Bose Corporation, Framingham, MA (US)

(72) Inventors: James P. Mulvey, Reading, MA (US); David J. Warkentin, Boston, MA (US); Emery M. Ku, Somerville, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/445,952

(22) Filed: Jun. 19, 2019

(51) Int. Cl.
*G10K 11/178* (2006.01)

(52) U.S. Cl.
CPC .. *G10K 11/17853* (2018.01); *G10K 11/17823* (2018.01); *G10K 2210/1081* (2013.01); *G10K 2210/3011* (2013.01); *G10K 2210/3026* (2013.01); *G10K 2210/3028* (2013.01)

(58) Field of Classification Search
CPC ..... G10K 11/17853; G10K 11/17823; G10K 2210/1081; G10K 2210/3011; G10K 2210/3028
USPC ..... 381/71, 1, 71.6
See application file for complete search history.

(56) References Cited

U.S. PATENT DOCUMENTS

| | | | | |
|---|---|---|---|---|
| 9,232,308 | B2 * | 1/2016 | Murata | H04R 3/00 |
| 9,576,588 | B2 * | 2/2017 | Goldstein | G10L 21/0208 |
| 9,654,874 | B2 * | 5/2017 | Park | H04R 3/02 |
| 9,980,034 | B2 * | 5/2018 | Kumar | H04R 3/00 |
| 10,244,306 | B1 | 3/2019 | Ku et al. | |
| 10,264,345 | B1 * | 4/2019 | Sapozhnykov | H04R 1/1008 |
| 10,462,581 | B2 * | 10/2019 | Wurzbacher | H04R 25/305 |
| 2008/0137873 | A1 * | 6/2008 | Goldstein | H04R 1/1016 381/57 |
| 2018/0115815 | A1 * | 4/2018 | Kumar | H04R 1/1008 |

* cited by examiner

*Primary Examiner* — Disler Paul
(74) *Attorney, Agent, or Firm* — Fish & Richard P.C.

(57) ABSTRACT

This document describes a method that includes receiving a driver signal for an acoustic transducer of an acoustic device. The method also includes receiving a signal from a microphone of the acoustic device, and, processing the driver signal through a filter to provide a reference signal. The filter has a transfer function associated with a condition of the acoustic device. The method also includes comparing the signal to the reference signal to determine whether the signal has a threshold similarity to the reference signal, and, indicating the condition of the acoustic device in respond to the determined threshold similarity.

20 Claims, 10 Drawing Sheets

REAL-TIME DETECTION OF CONDITIONS IN ACOUSTIC DEVICES

TECHNICAL FIELD

This description generally relates to detecting instabilities and other conditions in acoustic devices.

BACKGROUND

Various acoustic devices incorporate active noise reduction (ANR) features, also known as active noise control or cancellation (ANC), in which one or more microphones detect sound, such as exterior acoustics captured by a feedforward microphone or interior acoustics captured by a feedback microphone. Signals from a feedforward microphone and/or a feedback microphone can be processed to provide anti-noise signals to be fed to an acoustic transducer (e.g., a speaker, driver) to counteract noise that may otherwise be heard by a user. Feedback microphones may pick up acoustic signals produced by the transducer and form a closed loop system that could become unstable at times or under certain conditions.

SUMMARY

In general, in one aspect, this document features a method that includes receiving a driver signal for an acoustic transducer of an acoustic device. The method also includes receiving a signal from a microphone of the acoustic device, and, processing the driver signal through a filter to provide a reference signal. The filter has a transfer function associated with a condition of the acoustic device. The method also includes comparing the signal to the reference signal to determine whether the signal has a threshold similarity to the reference signal, and, indicating the condition of the acoustic device in respond to the determined threshold similarity.

In another aspect, this document features an acoustic device that includes a microphone for capturing audio, and a controller that includes one or more processing devices. The controller is configured to receive a driver signal for an acoustic transducer of the acoustic device, and, receive a signal from the microphone of the acoustic device. The controller is also configured to process the driver signal through a filter to provide a reference signal. The filter has a transfer function associated with a condition of the acoustic device. The controller is also configured to compare the signal to the reference signal to determine whether the signal has a threshold similarity to the reference signal, and, indicate the condition of the acoustic device in respond to the determined threshold similarity.

In another aspect, this document features one or more non-transitory machine-readable storage devices storing machine-readable instructions that cause one or more processing devices to execute operations. The operations include receiving a driver signal for an acoustic transducer of an acoustic device, and, receiving a signal from a microphone of the acoustic device. Operations also include processing the driver signal through a filter to provide a reference signal. The filter has a transfer function associated with a condition of the acoustic device. Operations also include comparing the signal to the reference signal to determine whether the signal has a threshold similarity to the reference signal, and, indicating the condition of the acoustic device in respond to the determined threshold similarity.

Implementations of the above aspects can include one or more of the following features.

The condition can comprise removal of the acoustic device from a user, blockage of an acoustic output of the acoustic device, acoustic leakage in an acoustic channel between the acoustic device and a user, damage to the acoustic device, etc. The acoustic device may be set into a low power mode in response to the indication of the condition. One or more parameters of the driver signal may be adjusted in response to the indication of the condition. A notification may be transmitted to a user device associated with the acoustic device in response to the indication of the condition. The notification may be configured to cause the user device to display the indication of the condition. The notification may be configured to cause the user device to pause audio playback to the acoustic device. The signal may be a feedback signal, feedforward signal, etc. and the microphone may be a feedback microphone, a feedforward microphone, etc. Comparing the signal to the reference signal to determine whether the signal has a threshold similarity to the reference signal may comprise determining a similarity over a predetermined number of samples. The driver signal may comprise an anti-noise signal.

These and other aspects, features, and implementations can be expressed as methods, apparatus, systems, components, program products, methods of doing business, means or steps for performing a function, and in other ways, and will become apparent from the following descriptions, including the claims.

DESCRIPTION OF DRAWINGS

Like reference symbols in the various drawings indicate like elements.

DETAILED DESCRIPTION

Figure 1:
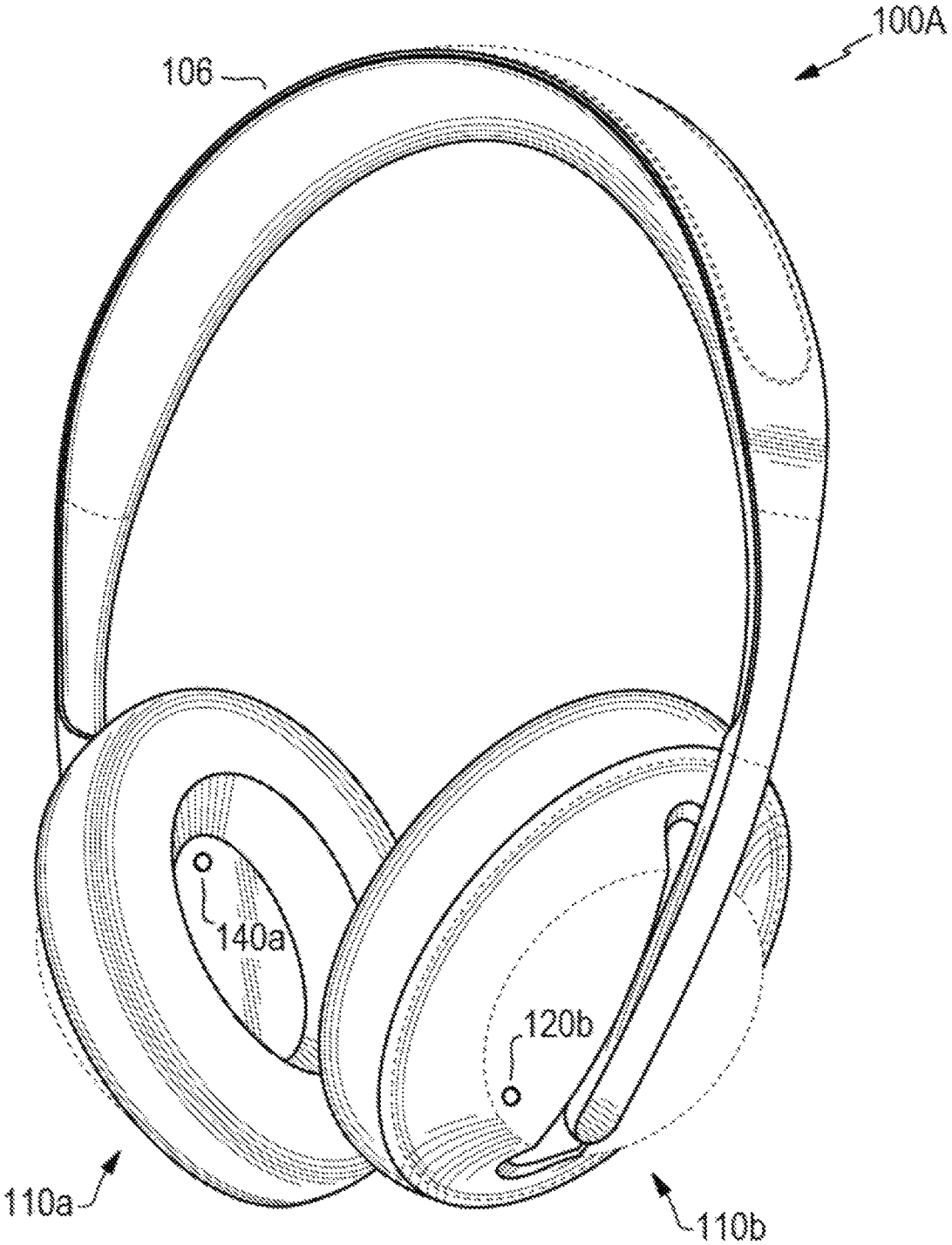
FIG. 1 is a perspective view of one example headset form factor.

Aspects of the present disclosure are directed to real-time detection of instabilities and other conditions in acoustic devices. Acoustic devices, such as headphones, headsets, or other acoustic systems, can include active noise reduction (ANR) or active noise cancellation (ANC) features that provide potentially immersive listening experiences by reducing the effects of ambient noise. Generally, ANR systems may include feedforward and/or feedback components. A feedforward component detects noise external to the acoustic device (e.g., via an external microphone) and acts to provide an anti-noise signal to counter the external noise expected to be transferred through the device to the user. A feedback component detects acoustic signals reaching the user (e.g., via an internal microphone) and processes the detected signals to counteract any signal components not intended to be part of the user's acoustic experience. In some cases, the feedback component may couple with an acoustic transducer of the acoustic device which can cause the ANR system to become unstable at times or under certain conditions. These instabilities can cause the acoustic device to generate an acoustic artifact (e.g., a loud noise) that is uncomfortable for the user. The techniques described here enable the acoustic device to detect an instability in the ANR system or another condition of the acoustic device, such as removal of the device by the user, a poor fit of the device on the user, or damage to the device, among others. Once detected, the acoustic device may take action to prevent or mitigate the instability or otherwise respond to the detected condition.

The technology described here may include or operate in headsets, headphones, hearing aids, or other personal acoustic devices, as well as acoustic systems that may be applied to home, office, or automotive environments. Throughout this disclosure the terms "headset," "headphone," "earphone," and "headphone set" are used interchangeably, and no distinction is meant to be made by the use of one term over another unless the context clearly indicates otherwise. Additionally, aspects and examples in accord with those disclosed here are applicable to various form factors, such as in-ear transducers or earbuds, on-ear or over-ear headphones, audio eyeglasses, open-ear audio devices (such as shoulder-worn or body-worn audio devices), and others.

Examples disclosed here may be coupled to, or placed in connection with, other systems, through wired or wireless means, or may be independent of any other systems or equipment. Examples disclosed may be combined with other examples in any manner consistent with at least one of the principles disclosed here, and references to "an example," "some examples," "an alternate example," "various examples," "one example" or the like are not necessarily mutually exclusive and are intended to indicate that a particular feature, structure, or characteristic described may be included in at least one example. The appearances of such terms here are not necessarily all referring to the same example.

Figure 2:
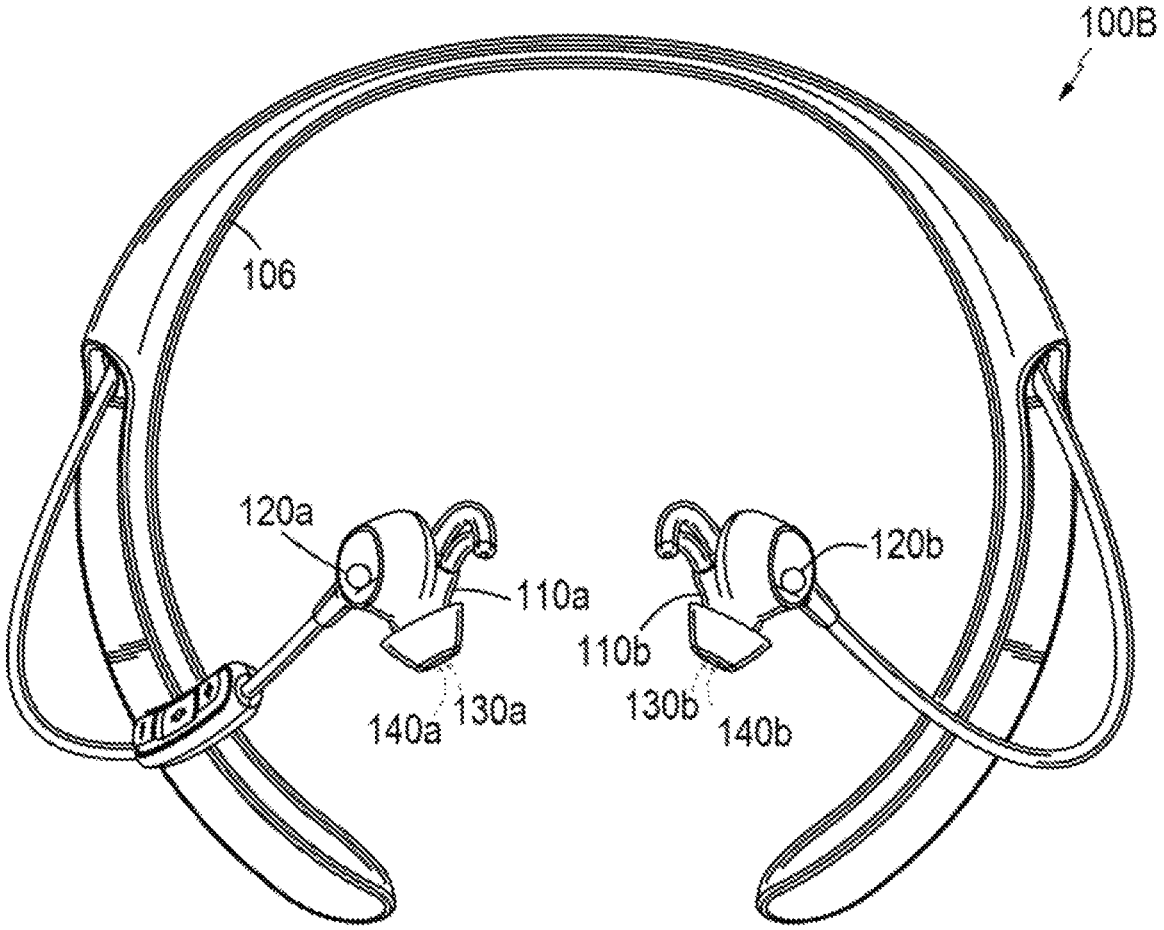
FIG. 2 is a perspective view of another example headset form factor.

FIGS. 1 and 2 illustrate two example headsets 100A, 100B. Each headset 100 includes a right earpiece 110*a* and a left earpiece 110*b* connected by a supporting structure 106 (e.g., a headband, neckband, etc.) to be worn by a user. In some examples, two earpieces 110 may be independent of each other and not connected by a supporting structure. Each earpiece 110 may include one or more microphones, such as a feedforward microphone 120 and/or a feedback microphone 140. The feedforward microphone 120 may be configured to sense acoustic signals external to the earpiece 110, e.g., to detect acoustic signals in the surrounding environment before they reach the user's ear. The feedback microphone 140 may be configured to sense acoustic signals internal to an acoustic volume formed with the user's ear when the earpiece 110 is worn, e.g., to detect the acoustic signals reaching the user's ear. Each earpiece also includes a driver 130, which may be an acoustic transducer for conversion of, e.g., an electrical signal, into an acoustic signal that the user may hear. In various examples, one or more drivers may be included in an earpiece. In some cases, an earpiece may include only a feedforward microphone or only a feedback microphone.

Although the reference numerals 120 and 140 are used to refer to one or more microphones, the visual elements illustrated in the figures may, in some examples, represent an acoustic port where acoustic signals enter to ultimately reach such microphones, which may be internal and not physically visible from the exterior. In some examples, one or more of the microphones 120, 140 may be immediately adjacent to the interior of an acoustic port, or may be removed from an acoustic port by a distance, and may include an acoustic waveguide between an acoustic port and an associated microphone.

Figure 3:
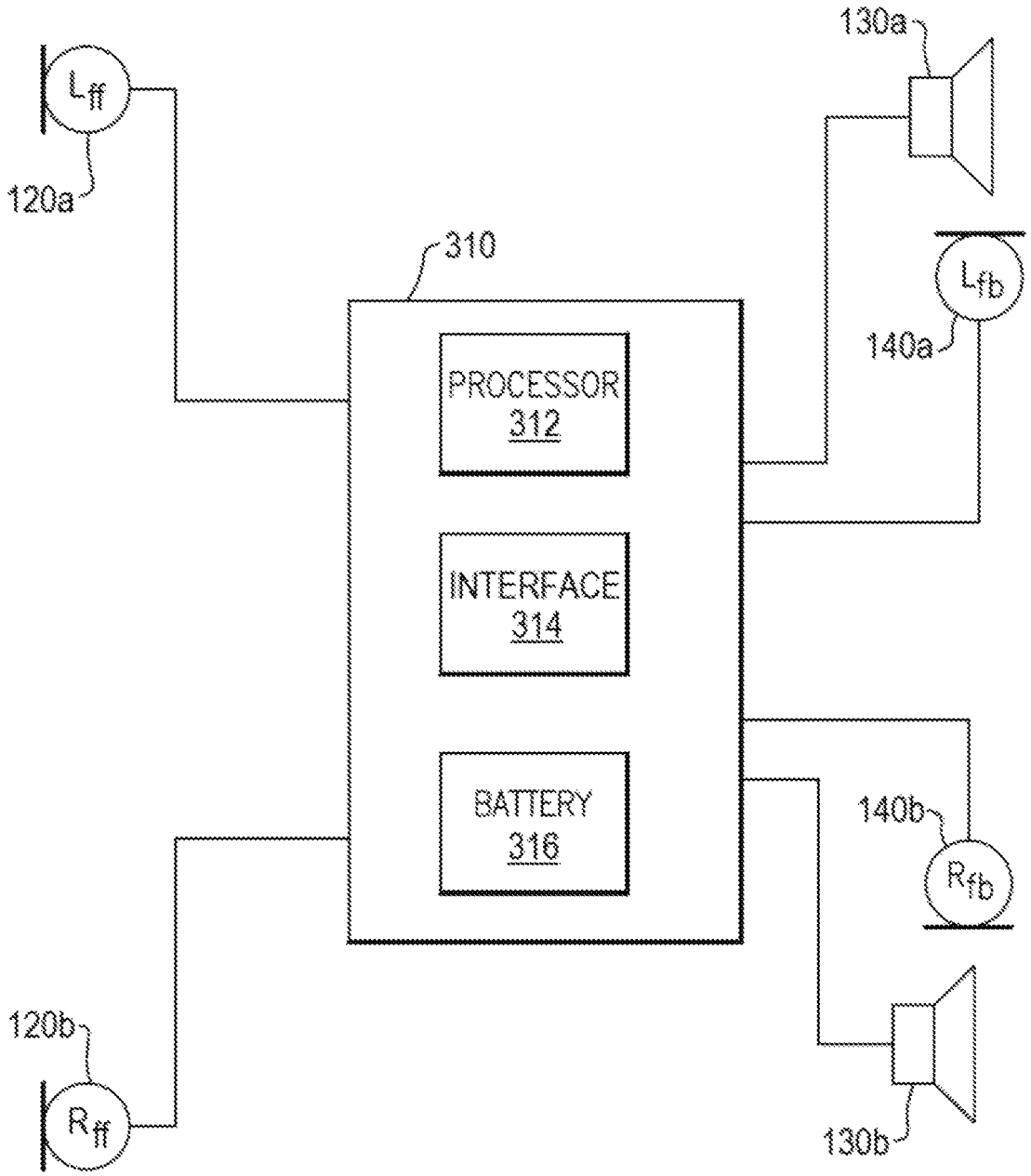
FIG. 3 is a schematic block diagram of an example acoustic processing system that may be incorporated into various acoustic systems.

As shown in FIG. 3, a processing unit 310 may be included on or within the headset 100. The processing unit 310 may include a processor 312, an acoustic interface 314, and a battery 316. The processing unit 310 may be coupled to one or more feedforward microphone(s) 120, driver(s) 130, and/or feedback microphone(s) 140. In some cases, the interface 314 may be a wired or a wireless interface for receiving acoustic signals, such as a playback acoustic signal or program content signal, and may include further interface functionality, such as a user interface for receiving user inputs and/or configuration options. In various examples, the battery 316 may be replaceable and/or rechargeable. In various examples, the processing unit 310 may be powered via means other than or in addition to the battery 316, such as by a wired power supply or the like. In some examples, a system may be designed for noise reduction only and may not include an interface 314 to receive a playback signal.

Figure 4:
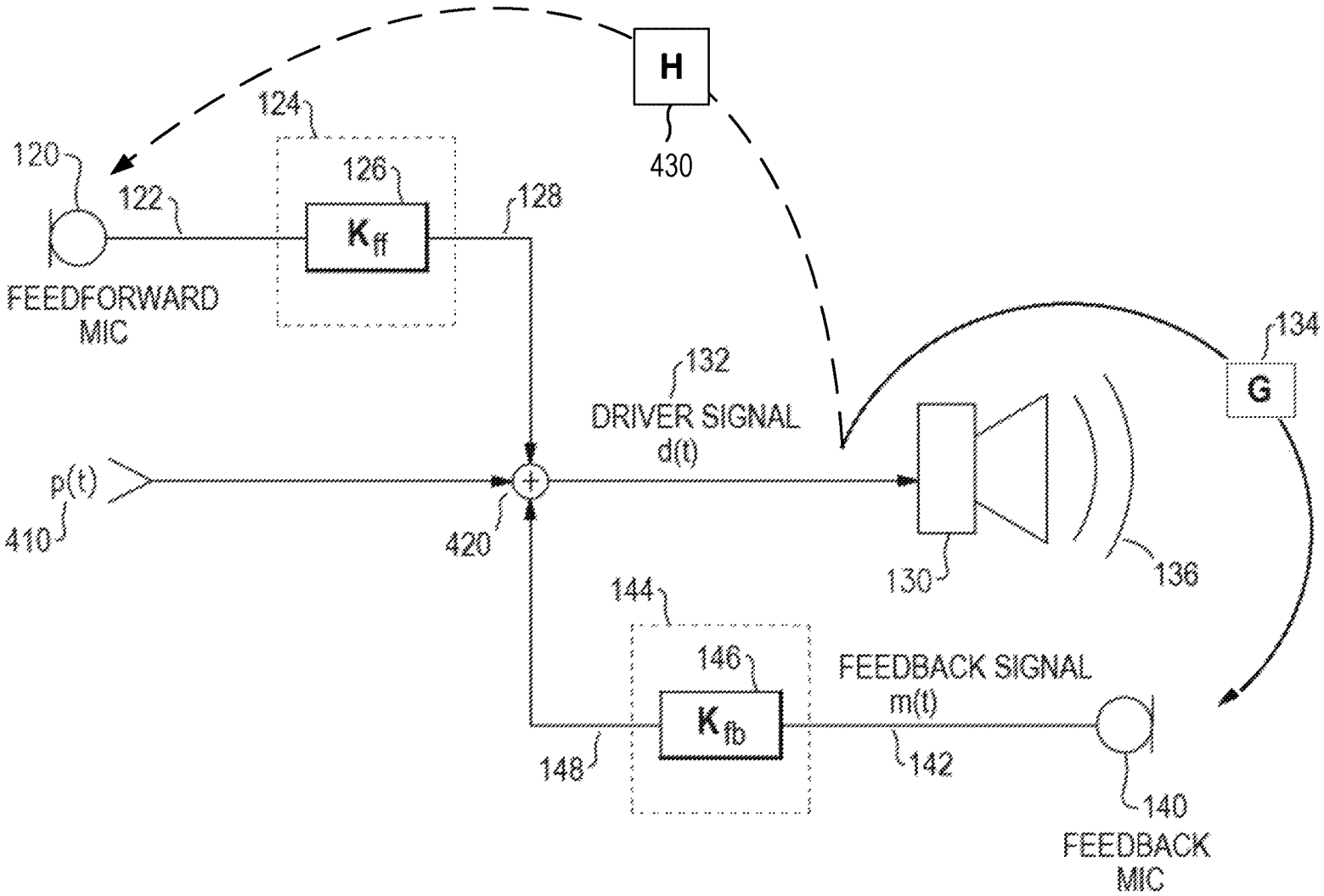
FIG. 4 is a schematic diagram of an example noise reduction system incorporating feedforward and feedback components.

In some implementations, the headset 100 may include a noise reduction system configured to process the signals from the feedforward and/or feedback microphones to reduce the acoustic noise reaching the user's ear. FIG. 4 presents a simplified schematic diagram to highlight features of a noise reduction system. Various examples of a complete system may include amplifiers, analog-to-digital conversion (ADC), digital-to-analog conversion (DAC), equalization, sub-band separation and synthesis, and other signal processing or the like. In some examples, a playback signal 410, p(t), may be received to be rendered as an acoustic signal by the driver 130. The feedforward microphone 120 may provide a feedforward signal 122 for processing by a feedforward processor 124, having a feedforward transfer function 126, $K_{ff}$, to produce a feedforward anti-noise signal 128. The feedback microphone 140 may provide a feedback signal 142 for processing by a feedback processor 144, having a feedback transfer function 146, $K_{fb}$, to produce a feedback anti-noise signal 148. In various examples, any of the playback signal 410, the feedforward anti-noise signal 128, and/or the feedback anti-noise signal 148 may be combined, e.g., by a combiner 420, to generate a driver signal 132, d(t), to be provided to the driver 130. In various examples, any of the playback signal 410, the feedforward anti-noise signal 128, and/or the feedback anti-noise signal 148 may be omitted and/or the components necessary to support any of these signals may not be included in a particular implementation of a system.

Various examples described here include a feedback noise reduction system, e.g., a feedback microphone 140 and a feedback processor 144 having a feedback transfer function 146 to provide a feedback anti-noise signal 148 for inclusion in a driver signal 132. The feedback microphone 140 may be configured to detect sound within the acoustic volume that includes the user's ear and, accordingly, may detect an acoustic signal 136 produced by the driver 130, such that a loop exists. Accordingly, in various examples and/or at various times, a feedback loop may exist from the driver signal 132 through the driver 130 producing an acoustic signal 136 that is picked up by the feedback microphone 140, processed through the feedback transfer function 146, $K_{fb}$, and included in the driver signal 132. Accordingly, at least some components of the feedback signal 142 are caused by the acoustic signal 136 rendered from the driver signal 132. Alternately stated, the feedback signal 142 includes components related to the driver signal 132.

The electrical and physical system shown in FIG. 4 exhibits a plant transfer function 134, G, characterizing the transfer of the driver signal 132 through to the feedback signal 142. In other words, the response of the feedback signal 142 to the driver signal 132 is characterized by the plant transfer function 134, G. The system of the feedback noise reduction loop is therefore characterized by the combined (loop) transfer function, $GK_{fb}$. If the loop transfer function, $GK_{fb}$, becomes equal to unity, $GK_{fb}=1$, at one or more frequencies, the loop system may diverge, causing at least one frequency component of the driver signal 132 to progressively increase in amplitude. This may be perceived by the user as an audible artifact, such as a tone or squealing, and may reach a limit at a maximum amplitude the driver 130 is capable of producing, which may be extremely loud. Accordingly, when such a condition exists, the feedback noise reduction system may be described as unstable.

Various examples of an earpiece 110 with a driver 130 and a feedback microphone 140 may be designed to avoid feedback instability or other condition, e.g., by designing to avoid or minimize the chances of the loop transfer function, $GK_{fb}$, having undesirable characteristics. Despite various quality designs, a loop transfer function, $GK_{fb}$, may nonetheless exhibit instability at various times or under certain conditions, e.g., by action of the plant transfer function 134, G, changing due to movement or handling of the earpiece 110 by the user, such as when putting a headset on or off, adjustment to the earpiece 110 while worn, or damage to the earpiece 110, among others. In some cases, a fit of the earpiece 110 may be less than optimal or may be out of the norm and may provide differing coupling between the driver 130 and the feedback microphone 140 than anticipated. Accordingly, the plant transfer function 134, G, may change at various times to cause an instability or other condition in the feedback noise reduction loop. In some examples, processing by the feedback processor 144 may include active processing that may change a response or transfer function, such as by including one or more adaptive filters or other processing that may change the feedback transfer function, $K_{fb}$, at various times. These changes may cause (or remedy) an instability or other condition in the feedback noise reduction loop.

Accordingly, in some implementations, the technology described here may operate to monitor for a condition in which a loop transfer function, $GK_{fb}$, becomes equal to unity, $GK_{fb}=1$, and may indicate that a feedback instability or other condition exists in response. With continued reference to FIG. 4, unity of the loop transfer function may be expressed as the plant transfer function 134, G, being equal to the inverse (e.g., reciprocal) of the feedback transfer function 146, $K_{fb}$, thereby satisfying the expression, $G=K_{fb}^{-1}$. Accordingly, a feedback noise reduction system may be unstable when a plant transfer function (e.g., 134) is the inverse of a feedback transfer function (e.g., 146).

As discussed previously, the feedback signal 142 may include components of the driver signal 132. When a feedback instability or other condition exists, components of the feedback signal 142 may be related to the driver signal 132 by the inverse of the feedback transfer function 146, because during an unstable condition the plant transfer function 134 may be inversely related to the feedback transfer function 146. The technology described here may detect feedback instability or the condition by monitoring for components in the feedback signal 142 that are related to the driver signal 132 such that the relationship is the inverse of the feedback transfer function 146. In some examples, the technology described here may include filters having transfer functions associated with other conditions of the acoustic device, such as an open nozzle condition, a leaky fit condition, a blocked port condition, and a damaged headset condition, to detect these other conditions. In some examples, the driver signal 132 is filtered by the inverse of the feedback transfer function 146 or another transfer function and the resulting signal is compared to the feedback signal 142. A threshold level of similarity may indicate that the plant transfer function 134 is nearly equal to the inverse of the feedback transfer function 146 or another transfer function, and thus may indicate that a feedback instability or another condition exists.

Figure 5:
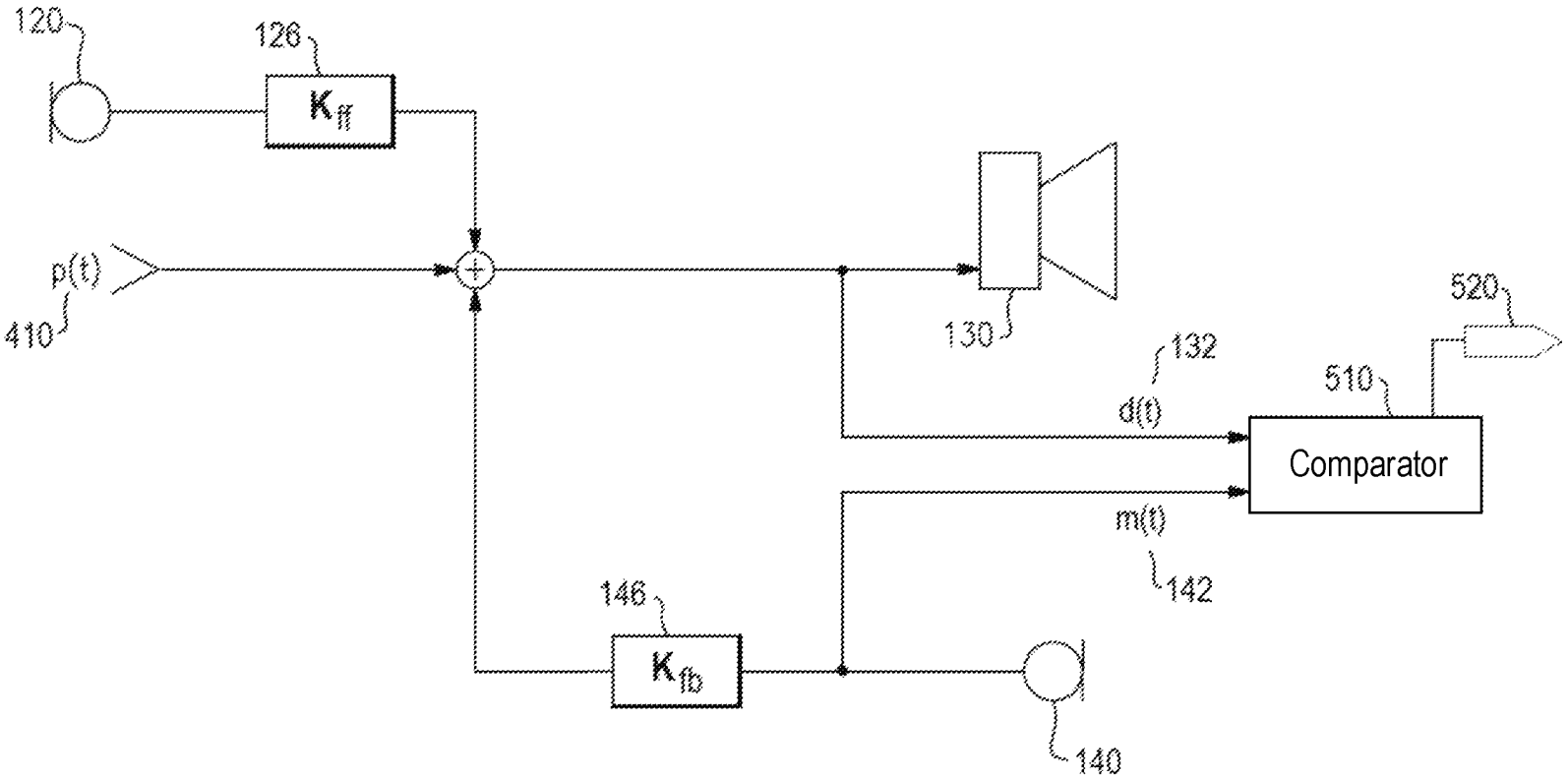
FIGS. 5, 6, 6A, and 7 are schematic diagrams of example systems for detection of instabilities and other conditions.

As shown in FIG. 5, the feedback signal 142 may be compared to the driver signal 132 by a comparator module 510, and if their relationship is similar to the inverse of the feedback transfer function 146, an instability indicator 520 may be provided. The instability indicator 520 may be, for example, a flag, indicator, or logic level signal (e.g., having high and low output levels) to indicate the presence or absence of instability or another condition, or may be any suitable type of signal for interpretation by various other components. For example, other components may receive the instability indicator 520 and may take action in response to an instability or other condition, such as reducing a gain in the feedback transfer function 146 (e.g., at one or more frequencies or frequency ranges).

Figure 6:
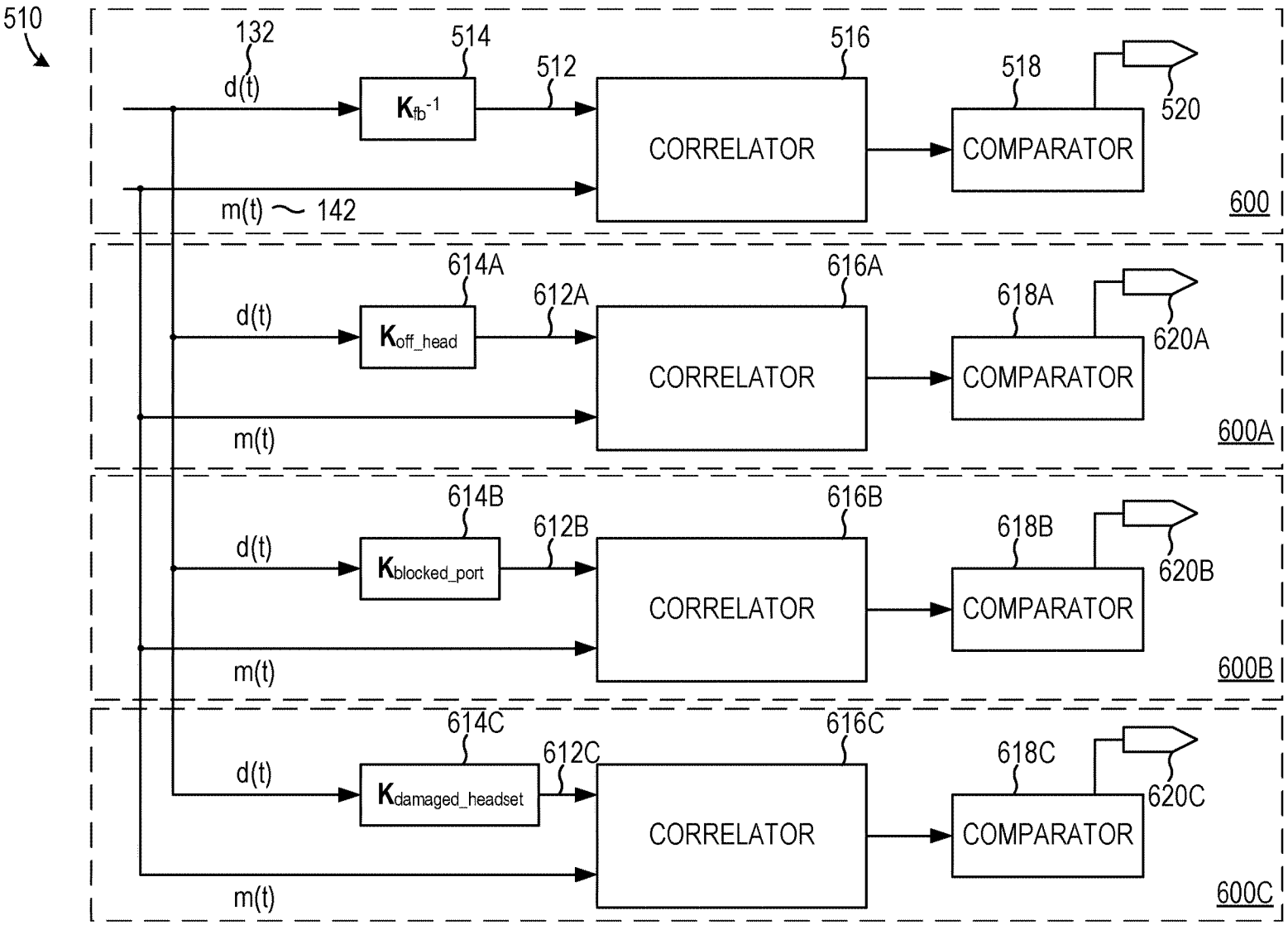

With reference to FIG. 6, at least one example of a comparator module 510 is illustrated, including a comparison module 600 suitable for comparing whether the feedback signal 142 is related to the driver signal 132 by an inverse of the feedback transfer function 146. The driver signal 132 is received and processed by a filter 514 having a transfer function, $K_{fb}^{-1}$, that is the inverse of the feedback transfer function 146 to provide a reference signal 512. In some examples, a delay may be applied to the feedback signal 142 to align the feedback signal 142 with the reference signal 512 (e.g., to match a delay added by the filter 514). A correlator 516 provides a correlation measurement between the feedback signal 142 and the reference signal 512, to quantify their similarity, and if their similarity meets a threshold (determined by a comparator 518), an instability or other condition is indicated by the instability indicator 520, which is an output signal of the comparator module 510. In various examples, the correlation measurement provided by the correlator 516 may be any of various measurements to correlate signals. In some examples, a cross-correlation may be calculated between the feedback signal 142 and the reference signal 512. In various examples, signal envelopes and/or signal energies in various sub-bands may be measured and compared, and/or various smoothing and/or weighting may be applied in various instances, and/or other processing to quantify a relationship between the feedback signal 142 and the reference signal 512. In various examples, the comparator 518 may apply a threshold level (e.g., of the quantified similarity) necessary to decide that an instability or other condition exists, and may also apply a threshold timeframe, such as an amount of time the similarity must remain above the threshold level. In some examples, an amount of time and/or a delay before indicating that an instability or other condition exists may be defined by a minimum number of samples, e.g., of the correlation of sampled signals in a digital domain, meeting the threshold level.

In some examples, multiple correlation measurements may be made by the comparison module 600, each of which may be compared to a threshold, any one or more of which may be deemed required to indicate an instability or other condition. For example, two distinct correlation measurements may be implemented in certain examples, and both may be required to meet a threshold to indicate an instability or other condition. In further examples, if one of the two distinct correlation measurements exceeds a higher threshold, such may be sufficient to indicate an instability or other condition even though the other of the two distinct correlation measurements fails to meet its threshold. In yet further examples, a third correlation measurement having its own threshold may confirm and/or over-ride the indication of instability (or other condition) generated by the first two correlation measurements, and the like.

In some examples, the comparator module 510 may include one or more comparison modules 600A-600C in addition to, or in lieu of, comparison module 600. For example, the comparator module 510 may include a comparison module 600A suitable for comparing whether the feedback signal 142 is related to the driver signal 132 by an "off-head" transfer function 614A, sometimes referred to as an "open nozzle" transfer function. Comparison module 600A may detect and indicate situations in which the headset has been taken off by the user, knocked off the user's head, fallen out of the user's ear, or otherwise removed from the user's head. In some examples, the comparator module 510 may include a comparison module 600B suitable for comparing whether the feedback signal 142 is related to the drive signal 132 by a "blocked port" transfer function 614B. Comparison module 600B may detect and indicate situations in which the headset has a clogged or dirty earbud, or situations in which the headset has been improperly inserted into or over a user's ears such that an acoustic pathway of the headset is occluded. In some examples, the comparator module 510 may include a comparison module 600C suitable for comparing whether the feedback signal 142 is related to the drive signal 132 by a "damaged headset" transfer function 614B. Comparison module 600C may detect and indicate failure modes of the headset such as damage to the acoustic transducers 130, damage to the feedback microphones 140, damage to the feedforward microphones 120, and/or damage to the earpieces 110, among other failure modes.

In some examples, comparator module 510 can include any subset or combination of comparison modules 600, 600A-600C. Moreover, comparator module 510 is not limited to the comparison modules described above, and may include any number of additional comparison modules suitable for detecting various conditions that may alter the plant transfer function 134. For example, one or more comparison modules can be included in comparator module 510, which detect and identify a "leaky fit" condition of the headset, in which the headset 100 is not entirely removed from a user's head, but is positioned such that the user's ears are not sufficiently isolated from noises external to the headset 100, or situations in which the feedforward microphones 120 are not sufficiently isolated from the acoustic signal 136 produced by the driver 130.

In general, each comparison module 600A-600C can operate analogously to comparison module 600. Each comparison module is suitable for comparing whether the feedback signal 142 is related to the driver signal 132 by a transfer function 614A-614C. The driver signal 132 is received and processed by a filter having transfer function 614A-614C to provide a reference signal 612A-612C. The filter may be one of a finite impulse response (FIR), infinite impulse response (IIR), or another adaptive filter, among others. In some examples, a delay may be applied to the feedback signal 142 to align the feedback signal 142 with the reference signal 612A-612C (e.g., to match a delay added by the filter 614A-614C). Correlation measurements are provided by correlators 616A-616C between the feedback signal 142 and the reference signal 612A-612C, to quantify their similarity, and if their similarity meets a threshold (as determined by comparators 618A-618C), an instability or other condition is indicated by the condition indicator 620A-620C, which is an output signal of the comparator module 510. In various examples, the correlation measurement provided by the correlators 616A-616C may be any of various measurements to correlate signals. In some examples, a cross-correlation may be calculated between the feedback signal 142 and the reference signal 612A-612C. In various examples, signal envelopes and/or signal energies in various sub-bands may be measured and compared, and/or various smoothing and/or weighting may be applied in various instances, and/or other processing to quantify a relationship between the feedback signal 142 and the reference signal 612A-612C. In various examples, the comparators 618A-618C may apply a threshold level (e.g., of the quantified similarity) necessary to decide that a condition exists, and may also apply a threshold timeframe, such as an amount of time the similarity must remain above the threshold level. In some examples, an amount of time and/or a delay before indicating that an instability exists may be defined by a minimum number of samples, e.g., of the correlation of sampled signals in a digital domain, meeting the threshold level. In some examples, in addition to having different transfer functions 614A-614C, each comparison module 600A-600C may implement similar or different types of filters, similar or different correlators 616A-616C, similar or different comparators 618A-618C, and/or similar or different time delays. For example, one or more adaptive filters may be used by one or more of the correlators 616A-616C.

Figure 6A:
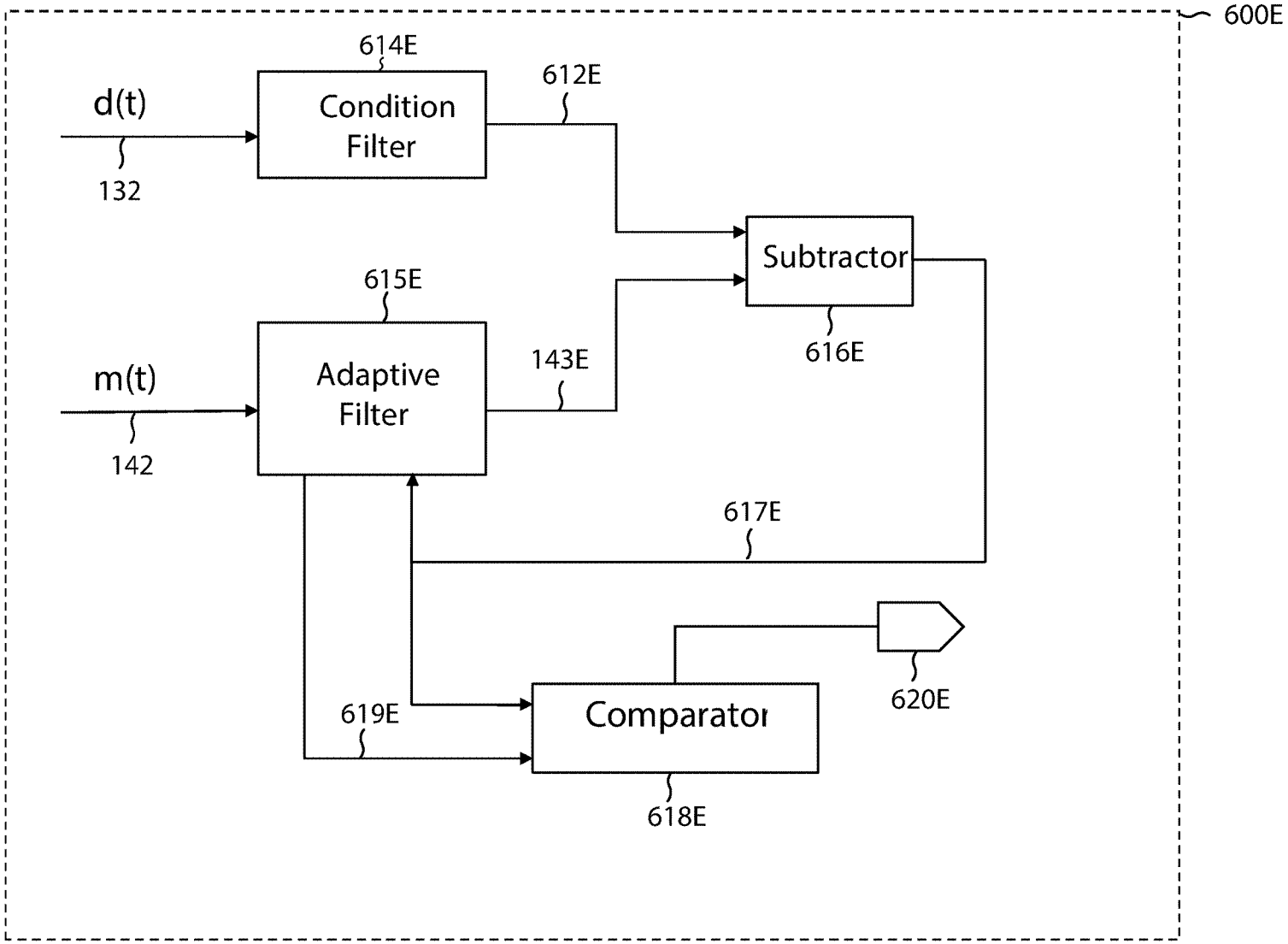

Referring to FIG. 6A, a comparison module 600E is presented that incorporates an adaptive filter. Employing the signaling description of FIG. 6, the driver signal d(t) 132 is provided to a condition filter 614E to produce a signal 612E that represents if a condition is experienced (e.g., by a microphone of an earbud). The feedback signal m(t) 142 is filtered by an adaptive filter 615E (e.g., having N taps) that produces a signal 143E. Over a period of time, the adaptive filter 615E attempts to match the signal 612E (produced by the condition filter 614E) to the signal 143E (produced by the adaptive filter). A subtractor module 616E produces a signal 617E that represents the difference between the signal 612E and signal 143E. The difference signal 617E is provided to the adaptive filter 615E and is used to iterate the filter coefficients (the taps) to adjust the signal 143E for matching the signal 612E. The signal 617E output from the subtractor module 616E is also provided to a comparator 618E, which is compared to a threshold. Filter coefficients 619E from the adaptive filter 615E are also provided to the comparator 618E, which are compared to a threshold pattern, in this example. If these comparisons report that either or both of the comparator inputs (e.g., the difference signal, the filter coefficients) exceed their respective threshold, an output signal 620E (e.g., an output flag) is generated.

Returning to FIG. 6, one or more thresholds and/or time delays may be employed for each condition. In general, a relatively short duration (e.g., 2 milli-second) is used to detect system instability while a time parameter for longer durations (e.g., 500 milli-second, 1 second, etc.,) can be used for detecting other system conditions such as "off-head"

(aka "open nozzle"). For one example of a threshold level, feedback $K_{fb}$ instability can be detected when a threshold defined as the filtered squared sum of the signals is larger than −30 dB with respect to full scale. A time delay can also be employed, e.g., calling for a ratio of the filtered squared sum of the signals to the filtered squared difference of the signals to be larger than 18 dB for at least 2 milli-seconds.

While some of the examples described above focus on feedback instabilities caused by coupling between the driver 130 and the feedback microphone(s) 140 of the headset 100, in some cases instability and other conditions may be detected based on coupling between the driver 130 and the feedforward microphone(s) 120. For example, referring again to FIG. 4, in certain conditions such as the "open nozzle" condition or "leaky fit" condition, the driver signal 132 may be picked up by the feedforward microphone(s) 120, and a second plant transfer function 430, H, may be exhibited, characterizing the transfer of the driver signal 132 through to the feedforward signal 122. In such scenarios, a loop transfer function, $HK_{ff}$, may be monitored to detect instabilities and other conditions in the feedback pathway, including an open nozzle condition, a leaky fit condition, a blocked port condition, and a damaged headset condition. Conditions such as instabilities can similarly be detected in the feedforward pathway. For example, the feedforward path can suffer a feedback squeal in some conditions when earbuds are in an Aware Mode (e.g., allowing some surrounding sounds to be heard by the earbuds user). If an earbud is cupped in the user's palm (e.g., when donning or removing the earbud), the cupped palm can create an acoustic feedback path from the driver to the outside microphone (causing the normally feedforward path to become a feedback path). The cupped-palm situation does not typically squeal when the earbud is very close to the user's ear; however, detecting to previse squealing is worthwhile for improving the user experience. Referring back to FIG. 6, monitoring the loop transfer function, $HK_{ff}$, may be accomplished using comparator module 510 with modified comparison modules 600, 600A-C such that instead of comparing the driver signal 132 to the feedback signal 142, the driver signal is compared to the feedforward signal 122.

Figure 7:
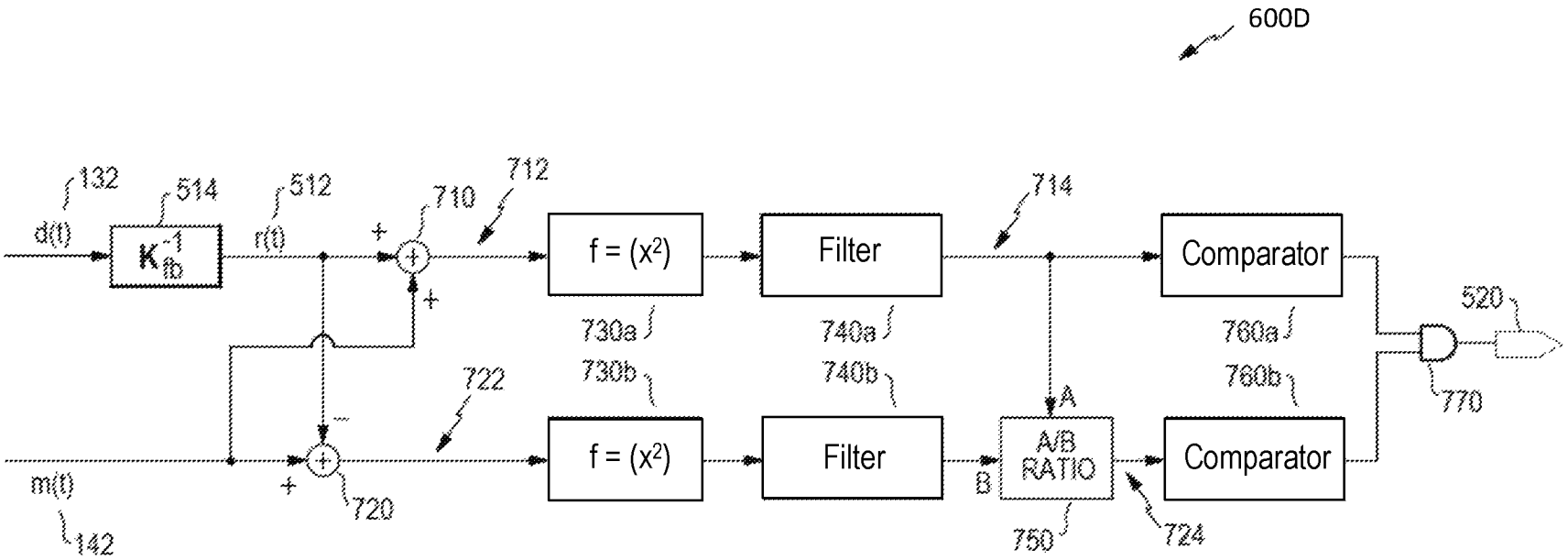

Referring to FIG. 7, a further example of a comparison module 600D is illustrated. As above, with reference to comparison module 600 in FIG. 6, the driver signal 132 is filtered (e.g., by filter 514) through an inverse transfer function, $K_{fb}^{-1}$, of the feedback transfer function 146, and the resulting reference signal 512 is compared to the feedback signal 142. In some examples, one or more other filters, such as one or more of filters 614A-614C, can be used instead of or in addition to filter 514. In some examples, the reference signal 512 may be a predictive signal, in that it may predict the feedback signal 142 during times of feedback instability (as discussed previously) or when another condition is present, such that comparison of the feedback signal 142 to the reference signal 512 may be used to detect that an instability or other condition exists.

With reference to FIG. 7, an example comparison module 600D includes a combiner 710 that adds the reference signal 512 to the feedback signal 142 to provide a summed signal 712, and a combiner 720 that subtracts the reference signal 512 from the feedback signal 142 (or vice versa, in other examples) to provide a difference signal 722. As described above, a feedback instability may exist when $G=K_{fb}^{-1}$, causing the reference signal 512 to be predictive of the feedback signal 142. Accordingly, when the feedback signal 142 is similar to the reference signal 512, an instability may exist. Further, when the feedback signal 142 is similar to the reference signal 512, the summed signal 712 may be expected to have relatively large amplitude and signal energy and the difference signal 722 may be expected to have relatively small amplitude and signal energy.

In some examples, each of the summed signal 712 and the difference signal 722 may be squared by respective function modules 730*a*, 730*b* and smoothed by respective filters 740*a*, 740*b* (e.g., low pass filters). For example, squaring a signal yields an output that is always positive and may be considered indicative of a signal energy. Smoothing a signal mitigates rapid changes in the signal, which may be considered low pass filtering, which may provide or be considered a signal envelope. Smoothing may be applied in various ways. At least one example may include alpha smoothing, in which each new signal sample, s[n], received over time (e.g., in a digital domain) is added to a running average of the prior samples, s_avg[n−1], according to a weighting factor, a, as illustrated by equation (1).

$$s_avg[n]=\alpha s[n]+(1-a)s_avg[n-1] \quad (1)$$

The weighting factor, α, may be considered a tunable time constant, for example. It should be recognized that various signal processing may be performed in either of an analog or digital domain in various examples, and that various signals may be equivalently expressed with either of a time parameter, t, or a digital sample index, n. In various examples, the weighting factor, α, may be the same in the two smoothing blocks 740. In other examples, the weighting factor, α, may be different for the two smoothing blocks 740.

With continued reference to FIG. 7, squaring and smoothing the summed signal 712 provides a primary signal 714 that is expected to have a relatively large value when an instability (or other condition) exists. By contrast, the difference signal 722 is expected to have relatively low amplitude, such that a squared and smoothed version is expected to have a relatively low value. In some examples, a ratio 750 may be taken, to provide a relative signal 724, which provides a single signal indicative of the extent to which both the summed signal 712 is large and the difference signal 722 is small, relative to each other. Accordingly, the relative signal 724 is expected to have a relatively large value when an instability (or other condition) exists.

Each of the primary signal 714 and the relative signal 724 may be tested against a respective threshold by a comparator 760*a*, 760*b*, each of which may apply varying thresholds, including a quantity threshold and optionally a time threshold (e.g., the amount of time, or number of digital samples, that a quantity threshold must be met). In various examples, a threshold applied by the comparator 760*a* for the primary signal 714 may be a fixed or variable threshold, selected based upon various aspects and/or settings (e.g., gain) related to various components of the system overall, such as a level of the driver signal 132. The threshold applied by the comparator 760*b* for the relative signal 724, may also be a fixed or variable threshold selected based upon various aspects, components, and/or settings of the system. In various examples, either or both of the thresholds applied by the comparators 760*a, b* may be selected based upon testing and characterization of the system as a whole, under conditions that cause instability and conditions that don't cause instability. In some examples, the threshold applied by comparator 760*b* is a fixed threshold in a range of 5 to 25 decibels (dB). In certain examples, the threshold applied by comparator 760*b* is a fixed threshold in a range of 12 to 18 dB, and in particular examples may be 12 dB, 15 dB, 18 dB, or other values.

With continued reference to FIG. 7, a logic 770 may combine outputs from the comparators 760*a, b*. In the example of FIG. 7, the logic 770 applies AND logic, requiring both of the primary signal 714 and the relative signal 724 to meet its respective threshold (as applied by the respective comparator 760*a*, 760*b*). In some examples, a minimum time and/or number of digital samples may be applied by the logic 770, e.g., a minimum number of samples that each of the primary signal 714 and the relative signal 724, potentially in combination, must meet its respective threshold (as applied by the respective comparator 760*a, b*. Various examples may user other combinations for logic 770, which may also incorporate signals from additional processing. In some examples, either of the primary signal 714 or the relative signal 724 meeting the respective threshold (as applied by respective comparator 760*a, b*) may be deemed sufficient to produce the output instability indicator 520 or another indicator 620A-620C. In some examples, additional thresholds may be applied (by additional comparators) to the signals shown and/or other signals. For instance, an additional threshold may be applied to the relative signal 724 that, when met, may be incorporated by the logic 770 to produce the output instability indicator 520 or other indicator 620A-620C even if the primary signal 714 fails to meet the threshold applied by comparator 760*a*.

According to some examples, a system may be tested and characterized and may be determined to be more likely to exhibit instabilities and other conditions at one or more frequencies and/or one or more frequency sub-bands. Accordingly, in some examples, the various processing illustrated, e.g., in FIGS. 6-7, may be performed within a range of frequencies and/or one or more sub-bands in which the instability or other condition is likely to occur. Additionally or alternately, each of a number of sub-bands or frequency ranges may have differing parameters applied by the various processing. For example, a threshold applied by comparator 760*b* may be a fixed value for one sub-band of the relative signal 724 and a different fixed value for another sub-band of the relative signal 724.

According to some examples, a system may be tested and characterized and may be determined to be more likely to exhibit high signal energies at one or more frequencies and/or one or more frequency sub-bands even though no feedback (or feedforward) instability exists. Accordingly, in some examples, the various processing illustrated, e.g., in FIGS. 6-7, may be configured to omit or ignore one or more sub-bands and/or range of frequencies.

According to some examples, a system may be tested and characterized and may be determined that more complex or less complex signal processing and/or logic may be beneficially applied to one or more sub-bands or frequency ranges than to others. Accordingly, in some examples, the various processing illustrated, e.g., in FIGS. 6-7, may vary significantly for differing ranges of frequencies and/or one or more sub-bands.

In various examples, as described above, detection of an instability or other condition is accomplished by analyzing a relationship between a feedback (or feedforward) microphone signal and a driver signal (e.g., by comparison of the feedback signal 142 to the driver signal 132) and one or more indicators 520, 620A-620C are provided. In response to receiving the one or more indicators 520, 620A-620C from the comparator module 510, other components may take actions corresponding to the specific indicator received.

For example, when the instability indicator 520 indicates that an instability (or other condition) is detected, the technology described here may take varying actions in response to the instability (or other condition), e.g., to mitigate or remove the instability (or other condition) and/or the undesirable consequences of the instability (or other condition). For example, an acoustic system in accord with those described may alter or replace the feedback transfer function 146, alter a feedback controller or feedback processor 144, change to a less aggressive form of feedback noise reduction, alter various parameters of the noise reduction system to be less aggressive, alter a driver signal amplitude (e.g., mute, reduce, or limit the driver signal 132), alter a processing phase response, e.g., of the driver signal 132 and/or feedback signal 142, in an attempt to disrupt the instability, provide an indicator to a user (e.g., an audible or vocal message, an indicator light, etc.), and/or other actions.

When the indicator 620A indicates that an "off-head" condition is detected, the technology described here may take varying actions in response to the off-head condition, e.g., to pause audio playback to the acoustic device, pause the output of the acoustic signal 136 produced by the driver 130, start a countdown timer for putting the headset into a standby or low-power mode, among others. In some cases, when the indicator 620A indicates that the "off-head" condition is no longer detected, the actions taken may be stopped or substantially reversed, e.g. to resume the output of the acoustic signal 136 produced by the driver 130, return the headset to an active mode, among others.

When the indicator 620B indicates that a "blocked port" condition is detected, the technology described here may take varying actions in response to the blocked port condition, e.g., to provide notification and recommendation to the user to clean or clear the headset port for a better acoustic experience, or to attempt to re-seat the headphone in the ear to remove any obstruction being generated by the ear itself. For example, a notification can be an audible notification, a push notification sent to a connected device, among others. The notification may provide instructions to the user, such as "left earbud is clogged, gently clean for better sound quality." In some cases, when the indicator indicates that the "blocked port" condition is no longer detected, the actions taken may be stopped or substantially reversed, e.g. to stop the audible notification, to clear the push notification, to notify the user that the headset port has been successfully cleared, among others.

When the indicator 620C indicates that a "damaged headset" condition is detected, the technology described here may take varying actions in response to the damaged headset condition, e.g., to provide notification and recommendation to the user to repair the headset. For example, a notification can be an audible notification, a push notification sent to a connected device, among others. The notification may provide repair instructions to the user and/or direct the user to a website or phone number that may provide tips or services for repairing the acoustic device. In some cases, when the indicator indicates that the "damaged headset" condition is no longer detected, the actions taken may be stopped or substantially reversed, e.g. to stop the audible notification, to clear the push notification, to notify the user that the headset port has been successfully repaired, among others.

The conditions detected and indicated using the technology described herein are not limited to the indicators 520, 620A-620C, but can extend to any condition that may alter the plant transfer functions 134, 430. For example, comparator module 510 may include an indicator that indicates a "leaky fit" condition. When the indicator indicates that a leaky fit condition is detected, the technology described here may take varying actions in response to the leaky fit condition, e.g., to provide notification and recommendation to the user to adjust the headset for a better acoustic experience. For example, a notification can be an audible notification, a push notification sent to a connected device, etc. The notification may provide instructions to the user, such as "headphone is loose in your right ear, gently push the earpiece in for better sound quality." In some cases, when the indicator indicates that the "leaky fit" condition is no longer detected, the actions taken may be stopped or substantially reversed, e.g. to stop the audible notification, to clear the push notification, to notify the user that the headset has been successfully adjusted, among others.

In general, any number of indicators may be implemented in addition to, or in lieu of, the indicators 520, 620A-620C described above, and any number of appropriate actions may be taken in response to the indication of a detected condition and/or the absence of a detectable condition. In some cases, the conditions detected by the headset system can be customized by the user. For example, a user interface can be presented to the user on a connected user device (e.g. a phone, a tablet, or a laptop, among others), allowing the user to select certain conditions they want the system to detect and/or specific actions that the user wants the system to take in response to detecting each of those conditions.

The above described aspects and examples provide numerous potential benefits to a personal acoustic device, such as one that includes noise reduction. Stability criteria for feedback control may be defined at the controller design stage, and various considerations assume a limited range of variation (of system characteristics) over the lifetime of the system. For example, driver output and microphone sensitivity may vary over time and contribute to the electroacoustic transfer function between the driver and the feedback microphone. Further variability may impact design criteria, such as production variation, head-to-head variation, variation in user handling, and environmental factors. Any such variations may cause stability constraints to be violated, and designers must conventionally take a conservative approach to feedback system design to ensure that instability (or other condition) is avoided. Such an instability (or other condition) may cause the noise reduction system to add undesired signal components rather than reduce them, thus conventional design practices may take highly conservative approaches to avoid an instability (or other condition) occurring, potentially at severe costs to system performance. In addition, conditions such as headset removal, blocked ports, headset damage, leaky fits, etc. may all contribute negatively to a user's acoustic experience or the power consumption of the acoustic device, among others.

However, aspects and examples of detecting instability and other conditions, as described here, allow corrective action to be taken to remove the instability and/or address the other conditions when such conditions occur. This can allow system designers to design systems that operate under conditions nearer to a boundary of instability, and thus achieve improved performance over a wider feedback bandwidth. Aspects and examples described here allow reliable detection if or when the instability boundary is crossed, and if or when a threshold is crossed, indicating the presence of another condition. For example, in an in-ear noise cancelling headphone, a user's handling may commonly block the "nozzle" of an earbud (e.g., a finger momentarily covering the audio port), which may cause an extreme physical change to the electroacoustic coupling between the driver and the feedback microphone. Conventional systems need to be designed to avoid instability even with a blocked nozzle, but instability detection in accord with aspects and examples described here allow the feedback controller or processor to be designed without the "blocked nozzle" condition as a constraint. Accordingly, the techniques described here may more than double the range of bandwidth in which noise reduction by a feedback processor may be effective.

Figure 8:
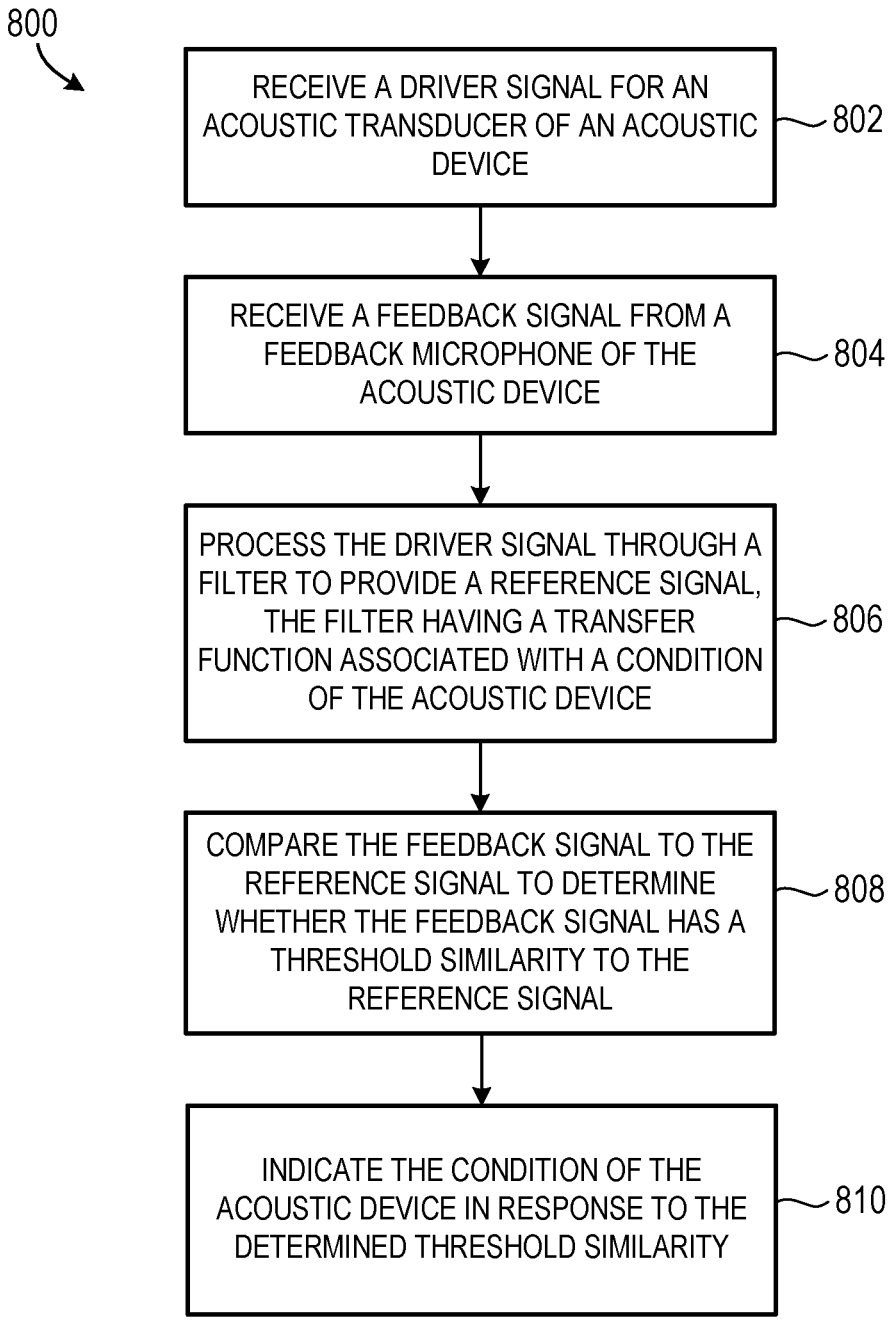
FIG. 8 is a flowchart of an example process for detecting a condition of an acoustic device.

FIG. 8 illustrates an example process 800 for detecting a condition of an acoustic device. At least a portion of the process can be implemented using one or more digital signal processors (DSPs), comparators, and comparison modules, such as comparator module 510 and comparison modules 600, 600A-600D described with reference to FIGS. 5-7. Operations of the process 800 include receiving a driver signal for an acoustic transducer of an acoustic device (802) and receiving a feedback signal from a feedback microphone of the acoustic device (804). In some implementations, the acoustic device may be or include an ANR device. In some implementations, the driver signal includes an anti-noise signal.

Operations of the process 800 further include processing the driver signal through a filter to provide a reference signal, the filter having a transfer function associated with a condition of the acoustic device (806). In some implementations, the condition includes removal of the acoustic device from a user. In some implementations, the condition includes blockage of an acoustic output of the acoustic device. In some implementations, the conditions includes acoustic leakage in an acoustic channel between the acoustic device and a user. In some implementations, the condition includes damage to the acoustic device.

Operations of the process 800 further include comparing the feedback signal to the reference signal to determine whether the feedback signal has a threshold similarity to the reference signal (808), and, indicating the condition of the acoustic device in response to the determined threshold similarity (810). In some implementations, determining whether the feedback signal has a threshold similarity to the reference signal includes determining a similarity over a predetermined number of samples. In some implementations, the acoustic device can be placed in a low power mode in response to the indication of the condition. In some implementations, one or more parameters of the driver signal can be adjusted in response to the indication of the condition. In some implementations, a notification can be transmitted to a user device associated with the acoustic device in response to the indication of the condition. The notification can cause the user device to display the indication of the condition. The notification can cause the user device to pause audio playback to the acoustic device.

Figure 9:
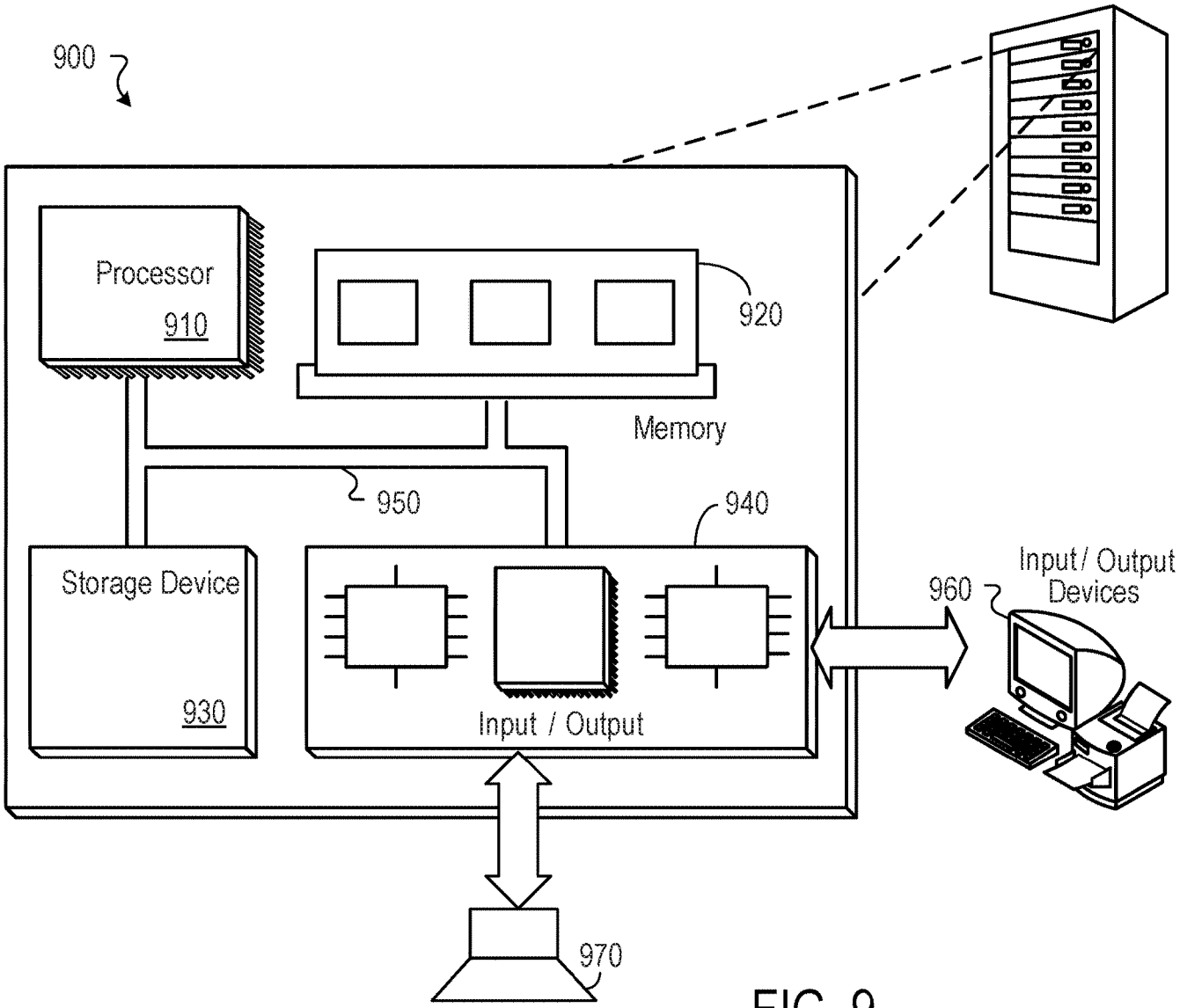
FIG. 9 is a block diagram of an example of a computing device.

FIG. 9 is block diagram of an example computer system 900 that can be used to perform operations described above. For example, any of the systems as described above (e.g., with reference to FIG. 6), can be implemented using at least portions of the computer system 900. The system 900 includes a processor 910, a memory 920, a storage device 930, and an input/output device 940. Each of the components 910, 920, 930, and 940 can be interconnected, for example, using a system bus 950. The processor 910 is capable of processing instructions for execution within the system 900. In one implementation, the processor 910 is a single-threaded processor. In another implementation, the processor 910 is a multi-threaded processor. The processor 910 is capable of processing instructions stored in the memory 920 or on the storage device 930.

The memory 920 stores information within the system 900. In one implementation, the memory 920 is a computer-readable medium. In one implementation, the memory 920 is a volatile memory unit. In another implementation, the memory 920 is a non-volatile memory unit.

The storage device 930 is capable of providing mass storage for the system 900. In one implementation, the storage device 930 is a computer-readable medium. In various different implementations, the storage device 930 can include, for example, a hard disk device, an optical disk device, a storage device that is shared over a network by multiple computing devices (e.g., a cloud storage device), or some other large capacity storage device.

The input/output device 940 provides input/output operations for the system 900. In one implementation, the input/output device 940 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 860, and acoustic transducers/speakers 970.

Although an example processing system has been described in FIG. 9, implementations of the subject matter and the functional operations described in this specification can be implemented in other types of digital electronic circuitry, or in computer software, firmware, or hardware, including the structures disclosed in this specification and their structural equivalents, or in combinations of one or more of them.

This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially generated propagated signal, e.g., a machine-generated electrical, optical, or electromagnetic signal, which is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers.

To provide for interaction with a user, embodiments of the subject matter described in this specification can be implemented on a computer having a display device, e.g., a light emitting diode (LED) or liquid crystal display (LCD) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser. Also, a computer can interact with a user by sending text messages or other forms of message to a personal device, e.g., a smartphone that is running a messaging application, and receiving responsive messages from the user in return.

Embodiments of the subject matter described in this specification can be implemented in a computing system that includes a back end component, e.g., as a data server, or that includes a middleware component, e.g., an application server, or that includes a front end component, e.g., a client computer having a graphical user interface, a web browser, or an app through which a user can interact with an implementation of the subject matter described in this specification, or any combination of one or more such back end, middleware, or front end components. The components of the system can be interconnected by any form or medium of digital data communication, e.g., a communication network.

Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

Other examples and applications not specifically described herein are also within the scope of the following claims. Elements of different implementations described herein may be combined to form other examples not specifically set forth above. Elements may be left out of the structures described herein without adversely affecting their operation. Furthermore, various separate elements may be combined into one or more individual elements to perform the functions described herein.

What is claimed is:

1. A method, comprising:

receiving a driver signal for an acoustic transducer of an acoustic device;

receiving a signal from a microphone of the acoustic device;

processing the driver signal through a first filter to provide a first reference signal and at least a second filter to provide a second reference signal, each filter having a transfer function associated with a different condition of the acoustic device;

comparing the signal to each of the first and second reference signals to determine whether the signal has a threshold similarity to the respective reference signal; and indicating one or more conditions of the acoustic device in response to the determined threshold similarity between the signal and each of the first and second reference signals.

2. The method of claim 1, wherein the one or more conditions include removal of the acoustic device from a user.

3. The method of claim 1, wherein the one or more conditions include blockage of an acoustic output of the acoustic device.

4. The method of claim 1, wherein the one or more conditions include acoustic leakage in an acoustic channel between the acoustic device and a user.

5. The method of claim 1, wherein the one or more conditions include damage to the acoustic device.

6. The method of claim 1, comprising:

setting the acoustic device in a low power mode in response to the indication of the one or more conditions.

7. The method of claim 1, comprising:

adjusting one or more parameters of the driver signal in response to the indication of the one or more conditions.

8. The method of claim 1, comprising:

transmitting a notification to a user device associated with the acoustic device in response to the indication of the one or more conditions.

9. The method of claim 8, wherein the notification is configured to cause the user device to display the indication of the one or more conditions.

10. The method of claim 8, wherein the notification is configured to cause the user device to pause audio playback to the acoustic device.

11. The method of claim 1, wherein the signal is a feedback signal and the microphone is a feedback microphone.

12. The method of claim 1, wherein comparing the signal to each of the first and second reference signals to determine whether the signal has a threshold similarity to the respective reference signal comprises determining a similarity over a predetermined number of samples.

13. The method of claim 1, wherein the driver signal comprises an anti-noise signal.

14. An acoustic device comprising:

a microphone for capturing audio; and a controller comprising one or more processing devices, wherein the controller is configured to:

receive a driver signal for an acoustic transducer of the acoustic device, receive a signal from the microphone of the acoustic device, process the driver signal through a first filter to provide a first reference signal and at least a second filter to provide a second reference signal, each filter having a transfer function associated with a different condition of the acoustic device, compare the signal to each of the first and second reference signals to determine whether the signal has a threshold similarity to the respective reference signal, and indicate one or more conditions of the acoustic device in response to the determined threshold similarity between the signal and each of the first and second reference signals.

15. The acoustic device of claim 14, wherein the one or more conditions include removal of the acoustic device from a user.

16. The acoustic device of claim 14, wherein the one or more conditions include blockage of an acoustic output of the acoustic device.

17. The acoustic device of claim 14, the one or more conditions include acoustic leakage in an acoustic channel between the acoustic device and a user.

18. The acoustic device of claim 14, wherein the one or more conditions include damage to the acoustic device.

19. One or more non-transitory machine-readable storage devices storing machine-readable instructions that cause one or more processing devices to execute operations comprising:

receiving a driver signal for an acoustic transducer of an acoustic device;

receiving a signal from a microphone of the acoustic device;

processing the driver signal through a first filter to provide a first reference signal and at least a second filter to provide a second reference signal, each filter having a transfer function associated with a different condition of the acoustic device;

comparing the signal to each of the first and second reference signals to determine whether the signal has a threshold similarity to the respective reference signal; and indicating one or more conditions of the acoustic device in response to the determined threshold similarity between the signal and each of the first and second reference signals.

20. The one or more non-transitory machine-readable storage devices of claim 19, wherein the one or more conditions include at least one of removal of the acoustic device from a user, blockage of an acoustic output of the acoustic device, acoustic leakage in an acoustic channel between the acoustic device and a user, or damage to the acoustic device.

* * * * *